US008950308B2

(12) United States Patent
Wallis

(10) Patent No.: US 8,950,308 B2
(45) Date of Patent: Feb. 10, 2015

(54) FORWARD CLOSURE SYSTEM

(75) Inventor: Bryce Wallis, Reno, NV (US)

(73) Assignee: Advanced Materials and Devices, Inc., Reno, NV (US)

( * ) Notice: Subject to any disclaimer, the term of this patent is extended or adjusted under 35 U.S.C. 154(b) by 25 days.

(21) Appl. No.: 13/426,434

(22) Filed: Mar. 21, 2012

(65) Prior Publication Data

US 2012/0240468 A1 Sep. 27, 2012

Related U.S. Application Data

(60) Provisional application No. 61/465,702, filed on Mar. 23, 2011.

(51) Int. Cl.

| | |
|---|---|
| ***F41F 3/077*** | (2006.01) |
| ***E05D 7/081*** | (2006.01) |
| ***E05F 15/12*** | (2006.01) |

(52) U.S. Cl.

CPC ..... *E05D 7/081* (2013.01); *F41F 3/077* (2013.01); *E05F 15/121* (2013.01)

USPC ..... 89/1.817; 49/61; 49/70; 52/66

(58) Field of Classification Search

CPC ..... F41F 3/00; F41F 3/07; F41F 3/073; F41F 3/077; E05F 15/121; E05D 7/081

USPC ..... 89/1.8, 1.816–1.817, 5, 36.03–36.04, 89/36.07–36.09; 244/121, 129.4; 52/6, 64, 52/66, 80.1; 49/33, 40–41, 61, 63–64, 67, 49/73.1, 103

See application file for complete search history.

(56) References Cited

U.S. PATENT DOCUMENTS

| | | | | | |
|---|---|---|---|---|---|
| 1,327,339 | A | * | 1/1920 | Logan | 244/121 |
| 1,806,366 | A | * | 5/1931 | Pivak | 244/121 |
| 3,135,163 | A | | 6/1964 | Mechlin, Jr. et al. | |
| 3,432,125 | A | * | 3/1969 | Schroeder, Jr. | 244/130 |
| 3,742,814 | A | | 7/1973 | Kroh | |
| 3,861,271 | A | * | 1/1975 | Osborn, Jr. | 89/1.8 |
| 3,962,951 | A | | 6/1976 | Schenk | |
| 4,301,708 | A | | 11/1981 | Mussey et al. | |
| 4,498,368 | A | | 2/1985 | Doane | |
| 4,833,837 | A | * | 5/1989 | Bonneau | 52/2.19 |
| 5,070,659 | A | * | 12/1991 | Brisbin et al. | 52/6 |
| 5,257,481 | A | * | 11/1993 | Reppas et al. | 52/6 |
| 5,625,982 | A | * | 5/1997 | Foote | 52/64 |
| 6,431,393 | B1 | * | 8/2002 | Stewart | 220/826 |
| 6,523,308 | B1 | * | 2/2003 | Gillispie | 52/67 |
| 6,837,393 | B1 | * | 1/2005 | Kuo | 220/263 |
| 7,464,900 | B2 | * | 12/2008 | Clark et al. | 244/171.7 |
| 2006/0081343 | A1 | * | 4/2006 | Clark et al. | 160/218 |
| 2006/0096449 | A1 | * | 5/2006 | Williams et al. | 89/1.817 |
| 2007/0017163 | A1 | * | 1/2007 | Silberman et al. | 52/41 |
| 2007/0289227 | A1 | * | 12/2007 | Parker et al. | 52/66 |

* cited by examiner

*Primary Examiner* — Troy Chambers
*Assistant Examiner* — Benjamin Gomberg
(74) *Attorney, Agent, or Firm* — Leech Tishman Fuscaldo & Lampl; Kenneth D'Alessandro

(57) ABSTRACT

A forward closure system includes a cylindrical frame. A pair of lune-shaped base sections are mounted to an inside surface of the frame. First and second opposed lune-shaped shell assemblies, each assembly including at least an outer shell section and an inner shell section, are rotatably mounted independently of each other at opposed ends along the rotation axis, the inner section and base sections of each shell assembly nested within the outer section when the forward closure system is in an open position, mating edges of the outer sections abutting one another when the forward closure system is in a closed position. An actuator is coupled to each outer shell section.

7 Claims, 17 Drawing Sheets

FORWARD CLOSURE SYSTEM

RELATED APPLICATIONS

This application claims the benefit of U.S. Provisional Application Ser. No. 61/465,702 filed on Mar. 23, 2011, the entirety of which is incorporated by reference herein.

GOVERNMENT LICENSE RIGHTS

This invention was made with government support under contract number N00030-08-C-0056/Q108CC/SRT awarded by the Department of the Navy. The government has certain rights in the invention.

This invention was made with government support under contract No. N00030-08-C-0056/Q108CCISRT awarded by the United States Navy. The government has certain rights in the invention.

BACKGROUND

1. Field of the Invention

The present invention relates to systems which can enclose an object that is sensitive to environmental conditions until it is ready to be launched (or leave) from the enclosure.

2. The Prior Art

Forward closure systems are used as devices to seal enclosures that contain an object, launchable from submerged, underground or surface launchers. Their primary goal is to act as an environmental seal while the launchable object is not in use, and to allow object egress during launch procedures.

In the prior art forward closure systems, the device is designed to be removed prior to launch of the object and is not reusable. In U.S. Pat. No. 3,135,163 to Mechlon et al., an explosive cord ruptures a diaphragm prior to an object launch. The detonation has to happen in a pre-determined pattern such that the debris from the diaphragm will not damage the object as well as the surrounding equipment.

In U.S. Pat. No. 3,742,814 to Kroh, the closure diaphragm is made up of a thin frangible plastic, which can be ruptured by the launched object. However, the drawback with this system is that, the launched object can be damaged while interacting with the plastic diaphragm. In addition, the thin diaphragm might not be strong enough for enclosures submerged at significant depths in water, and cannot withstand the hydrostatic pressure conditions.

U.S. Pat. No. 3,962,951 to Schenk, discloses the use of a hold down locking device to keep the shatterable type closure system in place. The closure may be made of asbestos-reinforced phenolic plastic. However, similarly, this closure system is ruptured by contact with the launched object, which can damage the launched object; moreover, debris generation still remains an issue.

A closure comprising of frangible glass ribs that form a dome shaped closure is disclosed in U.S. Pat. No. 4,301,708 to Mussey et al. A linear-shaped explosive charge arranged in a pre-determined pattern fragments the glass section prior to launch. The issue of excessive debris generation remains a problem with this design.

Another frangible fly-through diaphragm design is disclosed in U.S. Pat. No. 4,498,368 to Doane. This diaphragm is formed from epoxy and fiberglass plies, which are torn in a pre-determined path, during the fly-through launch of an object.

BRIEF DESCRIPTION

A Forward Closure System (FCS) according to the present invention includes means to protect the enclosed object from the environment and a method of fast opening to launch the object into the environment. The FCS structure can withstand high-pressure variations in both directions, from above and below, and is particularly suitable for underwater applications. The FCS can also withstand a wide range of temperatures, depending on the materials used for its fabrication. The opening surface of the FCS is sectioned into multiple separate shell components. Each shell is designed to slide under an adjacent shell that is larger in diameter, resulting in a structurally strong FCS that takes minimal space around the object being enclosed. The FCS can be sealed using many different techniques.

The FCS of the present invention can overcome all of the aforementioned drawbacks, such as, one-time use, debris generation, direct contact with the launched object, and inability to hold deep-sea pressures. The present invention can protect the enclosed object from environmental conditions prior to being launched, as well as actuate quickly enough, so that the launched object flies without any interference from the closure. The present invention provides a structure that is completely reusable. The only required replacement is the seals, which are torn during object launch. The torn seals produce minimal to no debris, which imposes no hazard to the launched object and surroundings. The fail-safe operation mode of the invention ensures that in the event of actuation malfunction, the launched object interacts with the system and opens it, with minimal force. Similarly, the main structure of the system is completely reusable and generates minimal debris even at its fail-safe operation mode. This invention can be equipped with sensors that communicate with a control system, so that different aspects, such as, opening/closing time can be controlled and changed via a user interface.

BRIEF DESCRIPTION OF THE DRAWING FIGURES

DETAILED DESCRIPTION

Persons of ordinary skill in the art will realize that the following description of the present invention is illustrative only and not in any way limiting. Other embodiments of the invention will readily suggest themselves to such skilled persons.

The Forward Closure System (FCS) device disclosed herein can be rigidly connected to a frame/chassis/vehicle that can be underwater or on the ground, where an object is to be enclosed by the FCS and protected from the environment. The device can be connected to an electric power supply, a pneumatic or hydraulic supply for actuation. The device can be equipped with position/angular sensors that can be connected to a control system. Based on the feedback from the position/angular sensors, the required electric current/actuation load can be supplied to the device. Upon application of the electric current/actuation load the FCS opens to allow for the enclosed object to pass through.

Figure 1:
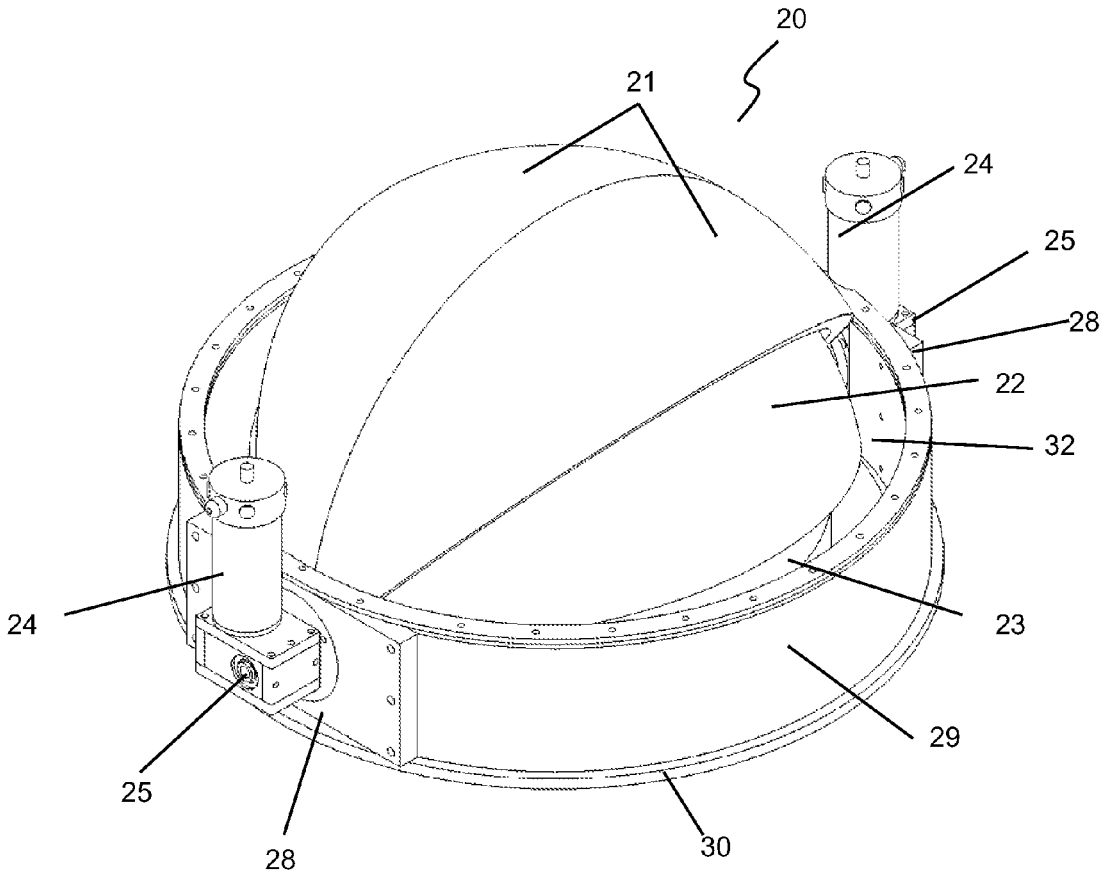
FIG. 1 is a drawing that shows an isometric view of the FCS in the closed position without the seals.

An illustrative embodiment of a Forward Closure System (FCS) 20 shown in FIG. 1 is composed of multiple shell sections. The example in FIG. 1 consists of 4 shell sections. Persons of ordinary skill in the art will appreciate that the number of shell sections employed can differ based on the overall size and operation requirements of the FCS. The outer sections 21 are the ones having the largest radii of all the sections. The inner sections 22 have a slightly smaller radius than the outer sections 21 to allow outer sections 21 to slide in a radial direction over inner sections 22. A cross-sectional isometric view of the FCS 20 is shown in FIG. 2.

Figure 2:
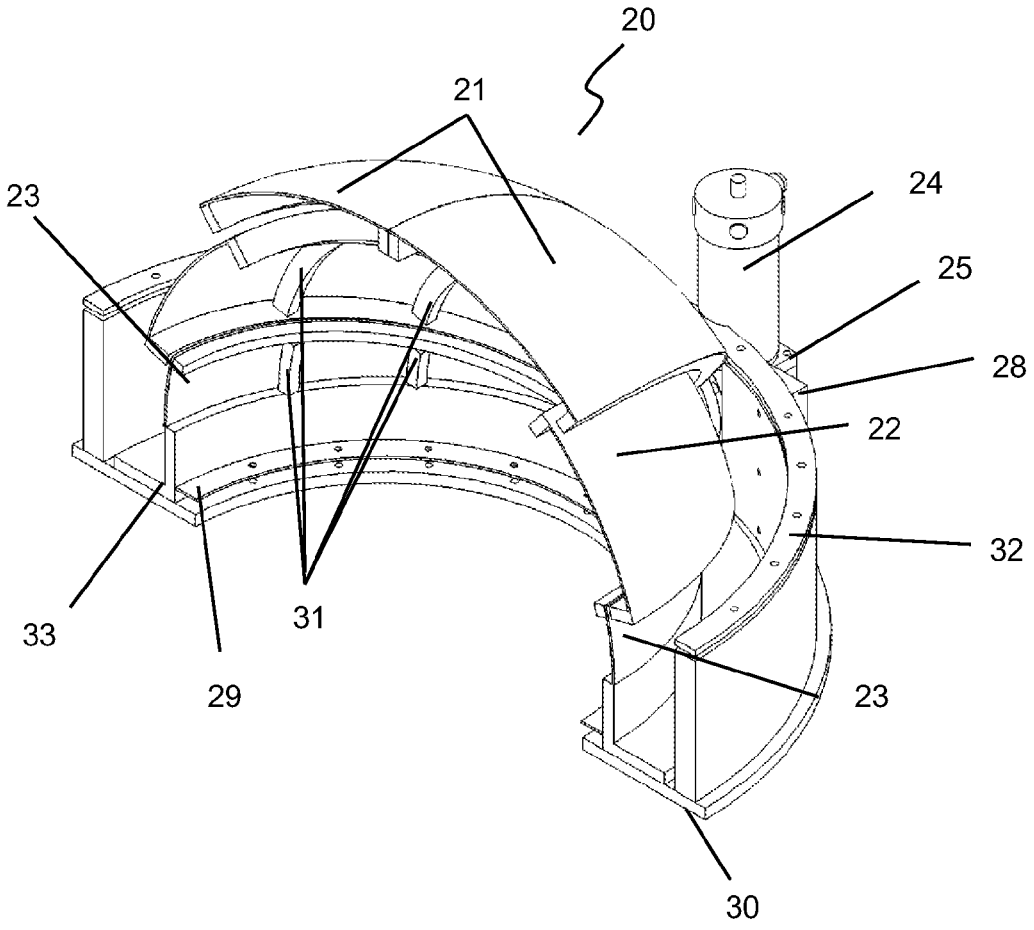
FIG. 2 is a drawing that shows a sectioned isometric view of the FCS in the closed position without the seals.

For the specific illustrated FCS design 20 as shown in FIG. 1 and FIG. 2, all rotating shell sections 21, 22 are connected to the stationary base section 23 which is a section having a smaller radius than sections 22. The rotating sections 21, 22 can be actuated with an actuator 24 or multiple actuators 24. The actuator(s) 24 can be AC or DC powered motors, electromagnetic actuators, hydraulic or pneumatic rotary actuators. Alternatively, a gearbox or another torque and speed-varying device 25 can be attached to each actuator to vary the torque applied on the rotating sections 21, 22. The selection of actuator power and gearbox design depends on the opening time, size and shape of the FCS.

Figure 3:
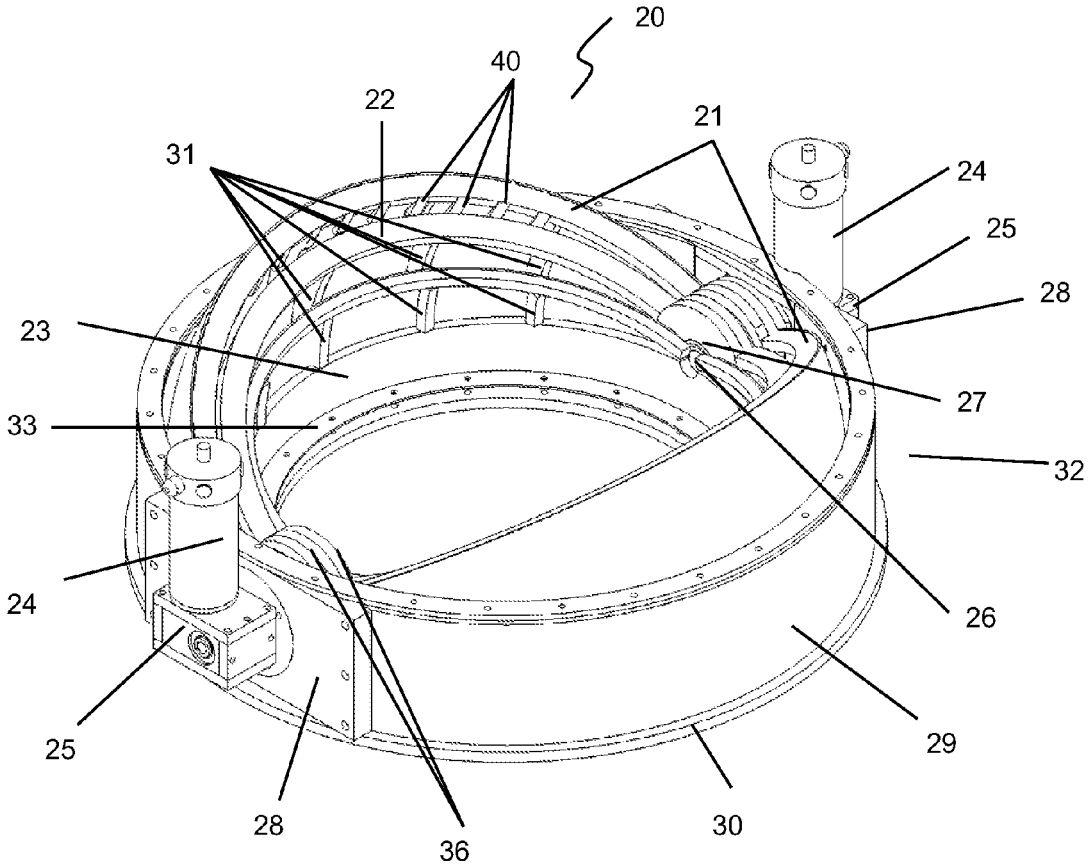
FIG. 3 is a drawing that shows an isometric view of the FCS in the opened position.

Once actuated, the FCS design 20 opens as demonstrated in FIG. 3. As shown in FIG. 3, all rotating sections 21, 22 are connected to the base section 23 via the pins 26 that are seated in bearing(s) 27. The actuator(s) 24 can be connected via actuator attachment plate(s) 28 to the seal attachment structure 29. The FCS design 20 can be rigidly attached to a frame 30 via the stationary base section 23 and the seal attachment structure 29. As shown in FIG. 2, the rotating sections 21, 22 and the stationary base section 23 are covered with a structural skin, and alternatively can include reinforcing rib/truss type elements 31 that can be designed according to the load carrying requirements on the FCS 20.

Figure 4:
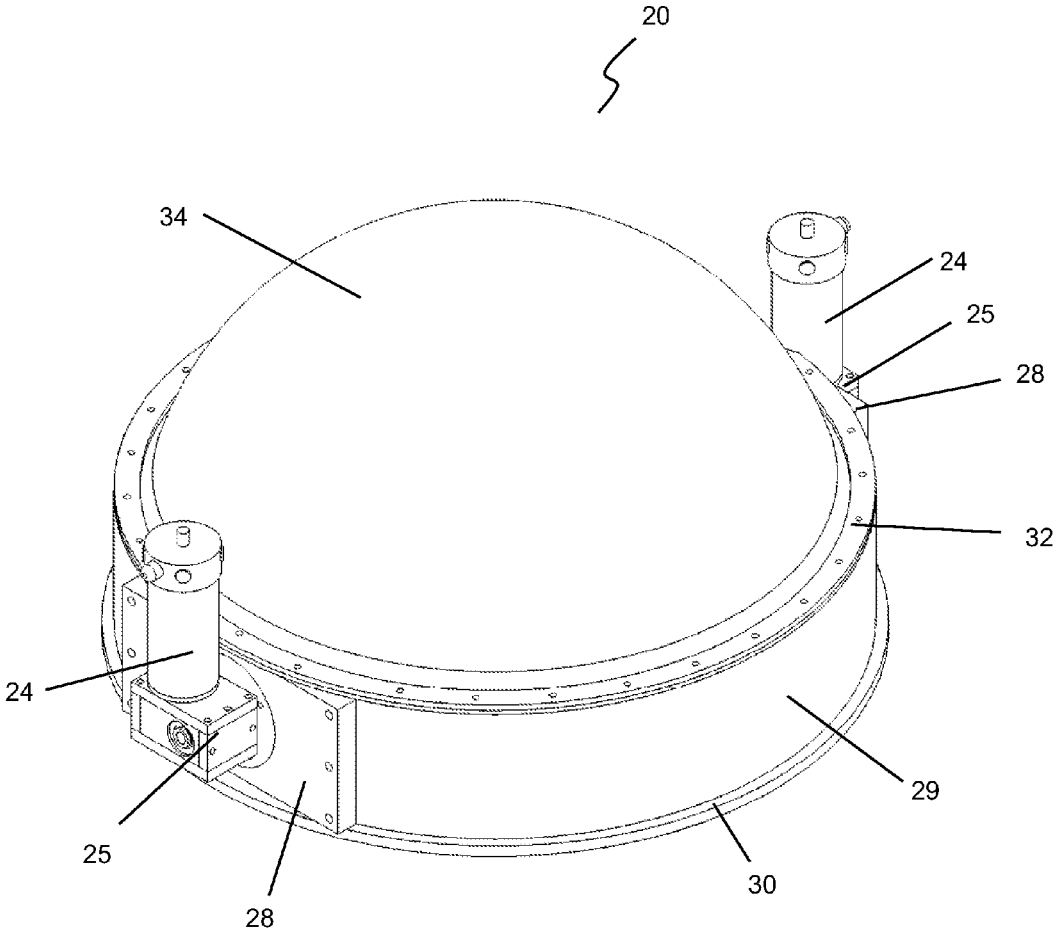
FIG. 4 is a drawing that shows an isometric view of the FCS in the closed position with the seals.
Figure 5:
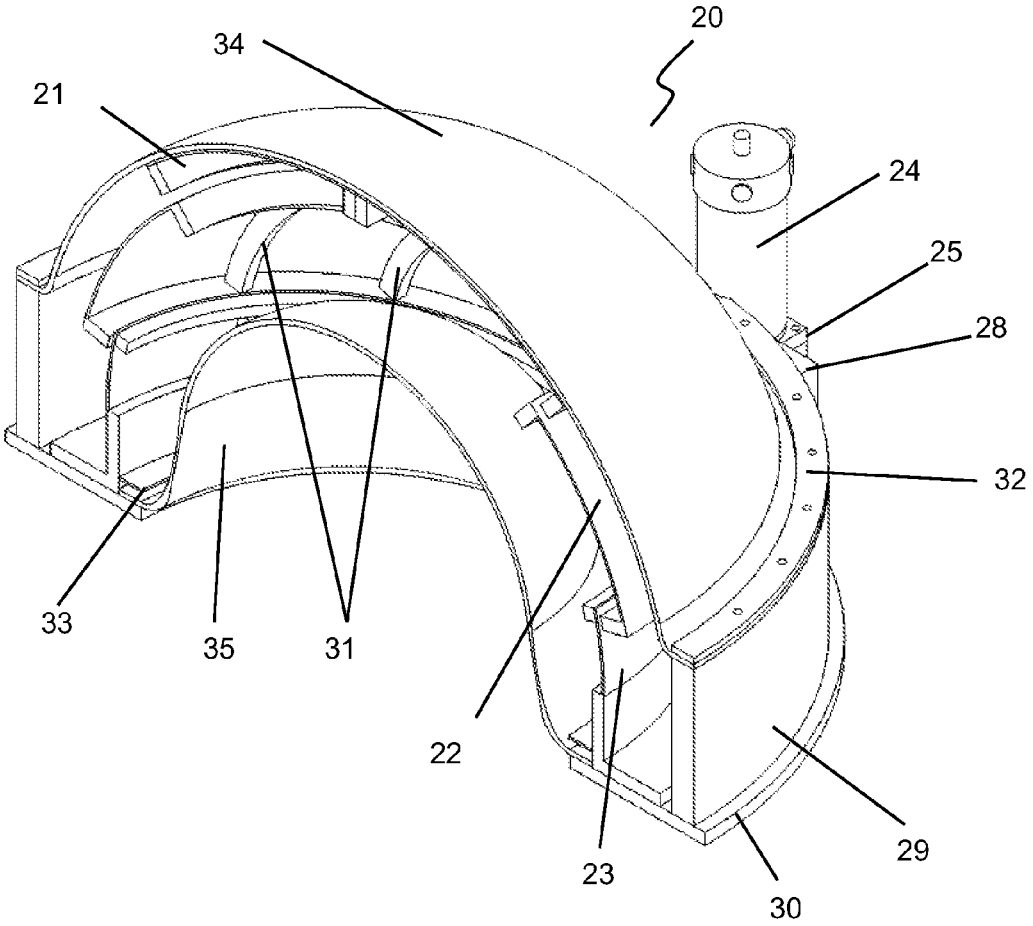
FIG. 5 is a drawing that shows a sectioned isometric view of the FCS in the closed position with the seals.

The FCS design 20 also includes an upper seal compression ring 32 and a lower seal compression ring 33. Once installed on a frame 30, the FCS design 20 requires an upper seal 34 and a lower seal 35, as shown in FIG. 4 as an assembly, and in FIG. 5, as a sectioned view to reveal the location of the lower seal 35. The seals 34, 35 are required if the object to be launched is to be protected from environmental conditions such as high pressure water (for underwater conditions), hazardous contaminants, and foreign objects, etc. The upper seal 34 and lower seal 35 can be made of elastomeric material or any other combination of materials that can be molded into the desired shape. The upper seal 34 and lower seal 35 can be directly attached to the outer sections 21. The means for connection can be mechanical fasteners. During opening the outer sections 21 tear apart the upper seal 34 and lower seal 35 to allow the launchable object to pass through the closure.

Figure 6:
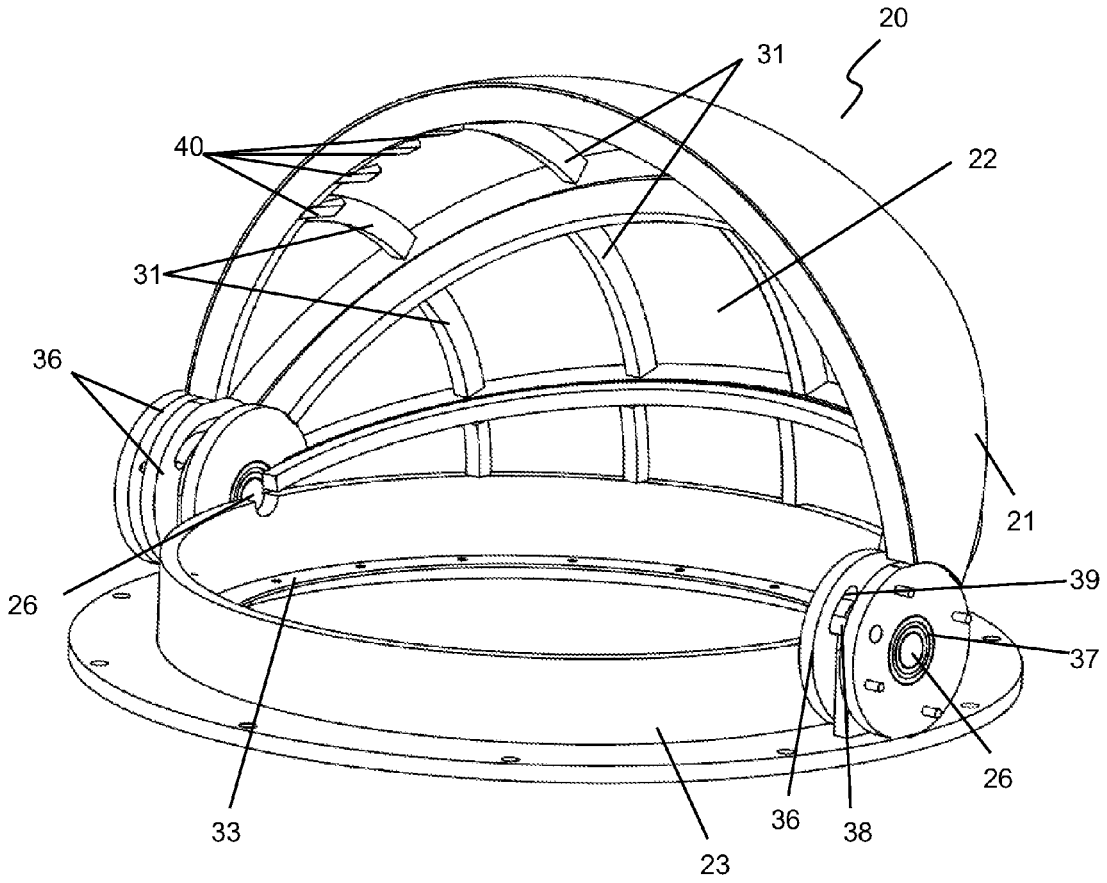
FIG. 6 is a drawing that shows the FCS with sections only on one side in the closed position to demonstrate the opening mechanism.
Figure 7:
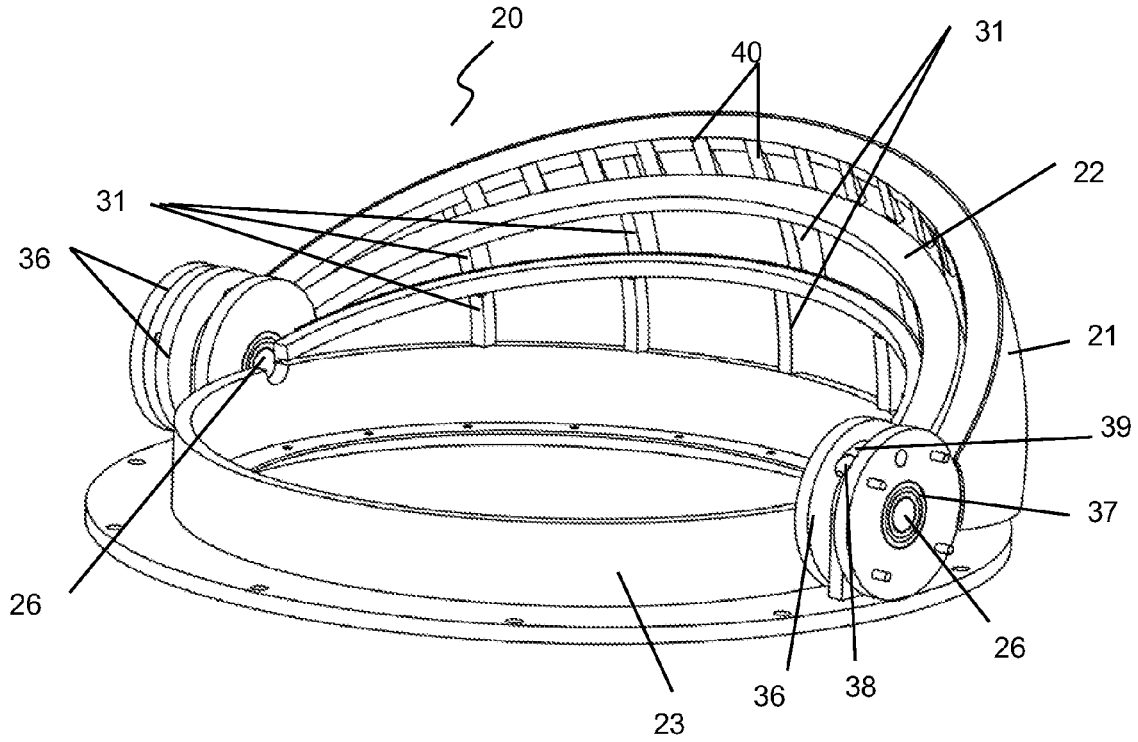
FIG. 7 is a drawing that shows the FCS with sections only on one side in open position to demonstrate how the system opens.

FIG. 6 is a view of the rotational joint sections 36 at the pin 26 location of the sections 21, 22 when the FCS design 20 is in its closed position. Only one side of the FCS design 20 is shown for better understanding of the mechanism. Each joint 36 contains a sealed bearing 37 for optimal rotation. The rotational joint sections 36 connected at the end of the rotating outer sections 21 contain a dowel pin 38 that can interact with the inner rotational sections 22. The inner rotational section 22 has a slot 39 that allows for relative movement during the opening of the FCS. Upon actuation of the outer rotational section 21, the dowel pin 38 moves along the slot 39 and engages with the inner rotational section 22 after a predetermined rotational angle, and opens the inner rotational section 22. FIG. 7 presents the FCS design 20 in the open position.

Figure 8:
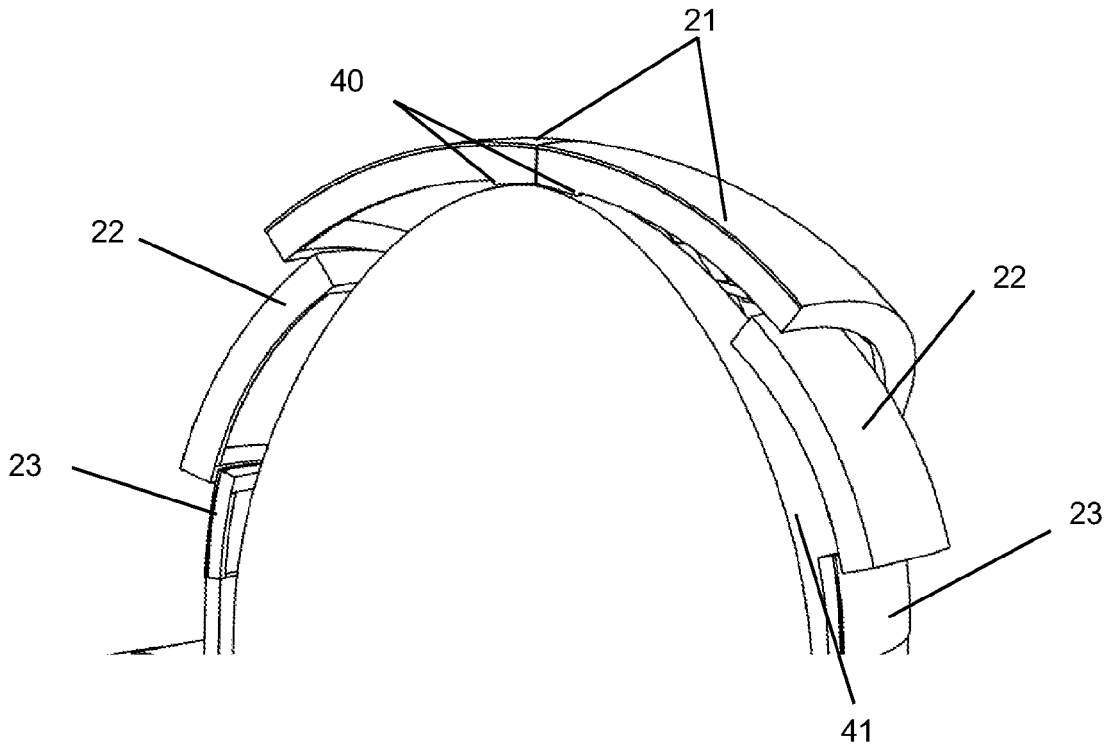
FIG. 8 is a drawing that shows a sectioned view of the FCS revealing the fail-safe operation mechanism.

The FCS design 20 also includes fail-safe features for emergency operation conditions, in case the actuators 24 fail to open the system. Each outer section 21 includes at least one fail-safe operation tab 40, as demonstrated in FIG. 8, that can be designed based on the launched object 41 nose profile. If the actuators 24 fail to operate, the launched object 41 hits the fail-safe operation tab(s) 40. The upwards axial movement of the launched object 41 is directed sideways via the fail-safe operation tab(s) 40. This generates a torque on the pin 26 locations which can tear the upper seal 34, the lower seal 35 and pry open the FCS sections 21, 22, simultaneously, without damaging the launched object 41.

After normal or fail-safe operation of the FCS design 20, no structural part except the upper seal 34 and the lower seal 35 is damaged. The embodiment shown in FIG. 4 produces minimal amount of debris. After opening, only the seals 34, 35 need to be replaced, therefore, the FCS design 20 structure is reusable.

Figure 9:
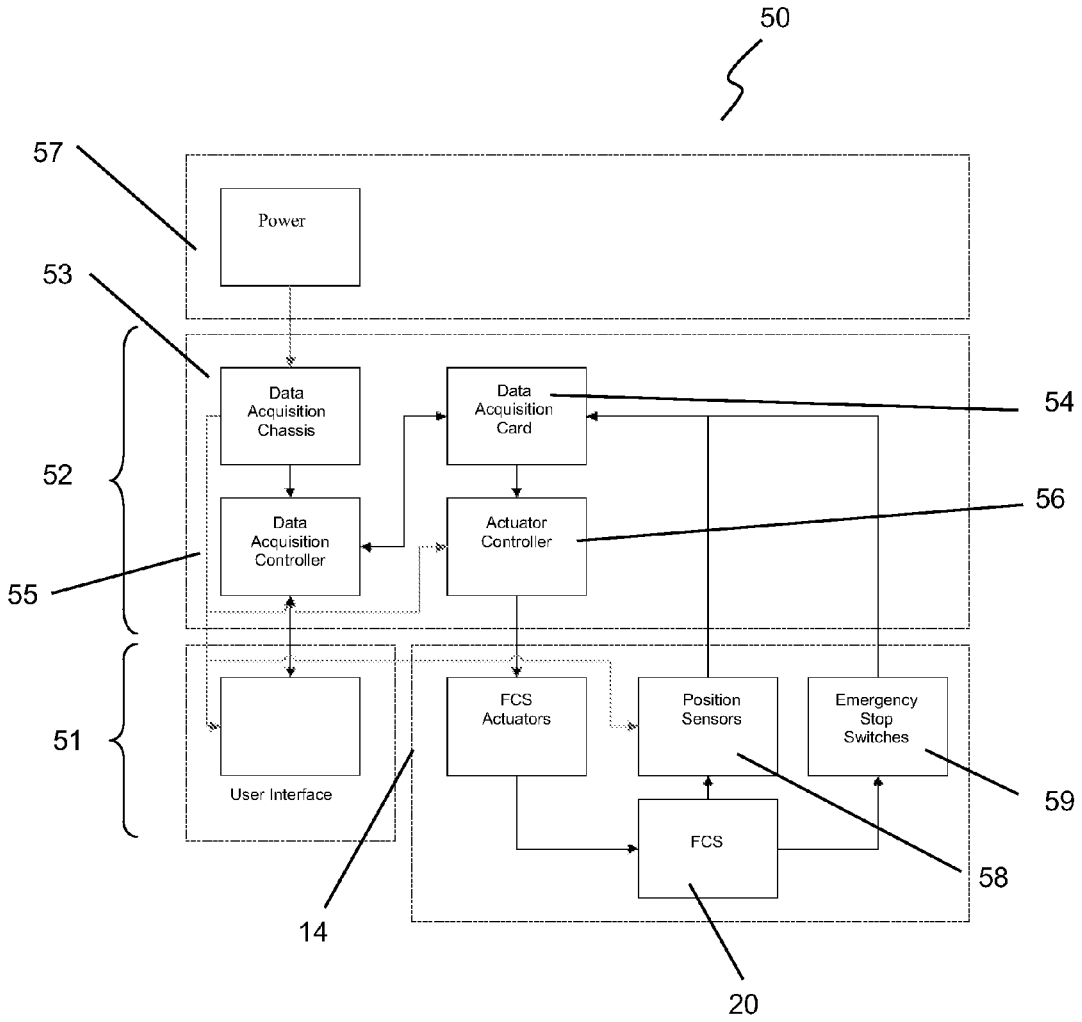
FIG. 9 is a block diagram illustrating how an exemplary user interface, control system and FCS can interact.

The operation of the FCS design 20 can be controlled via a control system 50 that includes a user interface 51 and other control system hardware 52, as illustrated in the block diagram of FIG. 9. The user interface 51 can be a computer, where the user can enter operating parameters. The control system hardware 52 also includes a data acquisition chassis 53 that is powered externally 57, a data acquisition card 54, a data acquisition controller 55 and an actuator controller 56. The data acquisition chassis 53 can supply the power 57 to the user interface 51, actuator controller 56 and the position sensor(s) 58. The position sensor(s) 58 can be any type of angle or displacement transducer that feedback the position of the outer rotational sections 21 to the control system 50. Based on the user interface 51 input of the required opening time and feedback from the position sensor(s) 58, the actuator controller 56, can adjust the driving force (whether it is an electric current, hydraulic pressure supply valve or pneumatic supply valve), so that the FCS design 20 opens in the required time. The FCS design 20 also employs at least two mechanical emergency stop switches 59 that can send a signal to the control system 50 that the FCS design 20 is open, in the event the position sensor(s) 58 malfunction. Persons of ordinary skill in the art will appreciate that the partitioning of the control system hardware 52 shown in FIG. 9 into various sub-components is illustrative only and that other partitioning of the functions performed by control system hardware 52 is within the scope of the present invention.

Figure 10:
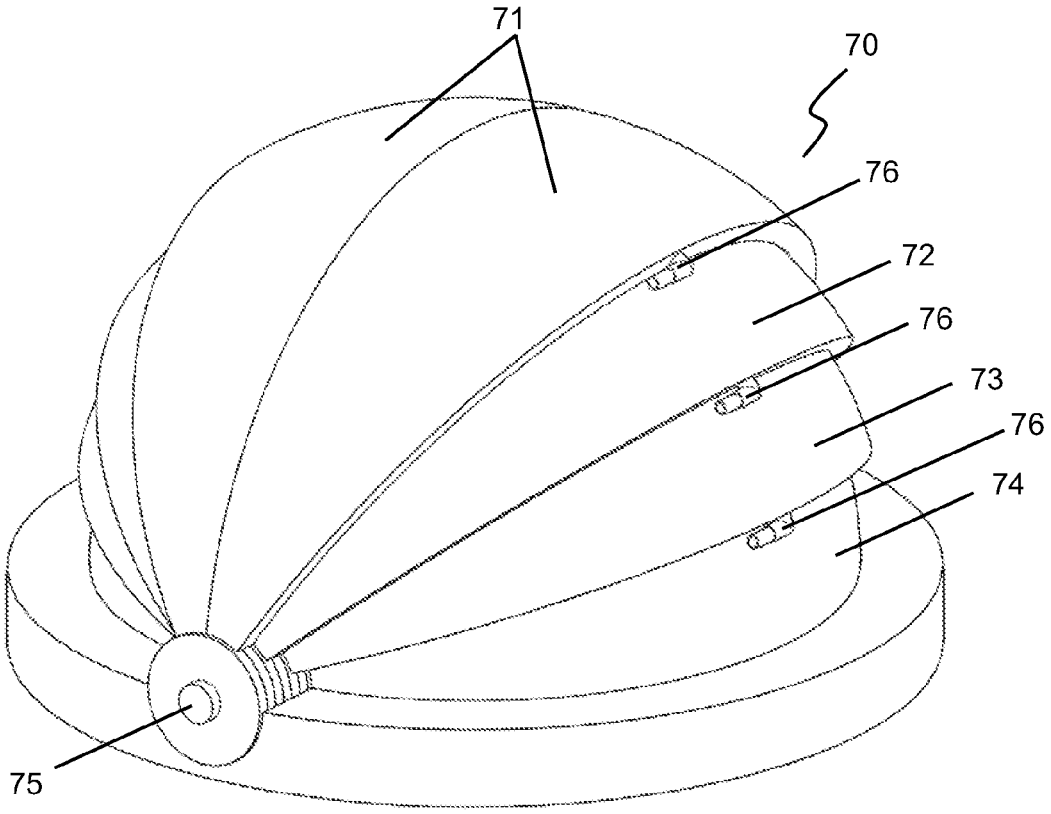
FIG. 10 is a drawing that shows an alternative embodiment of the FCS invention in the closed position.

In an alternative embodiment of the FCS invention shown in FIG. 10, the FCS design 70 is composed of multiple shell sections each including a port 76. The embodiment in FIG. 10 consists of 8 shell sections. The main upper section 71 is the one with the largest radius out of all the sections. Section 72 has a slightly smaller radius than section 71 to allow section 71 to slide in a radial direction over section 72. Likewise, section 73 has a smaller radius than section 72 in order to allow section 71 and 72 to slide over section 73. Section 74 is a section with a smaller radius than section 73 allowing all other sections 71, 72, 73 to slide over section 74. All sections 71, 72, 73, 74 are connected with a pin 75. Sections 71, 72, and 73 contain ports 76 to allow a fluid to flow in between the shell sections to actuate the sections when the FCS 70 is to be opened.

Figure 11:
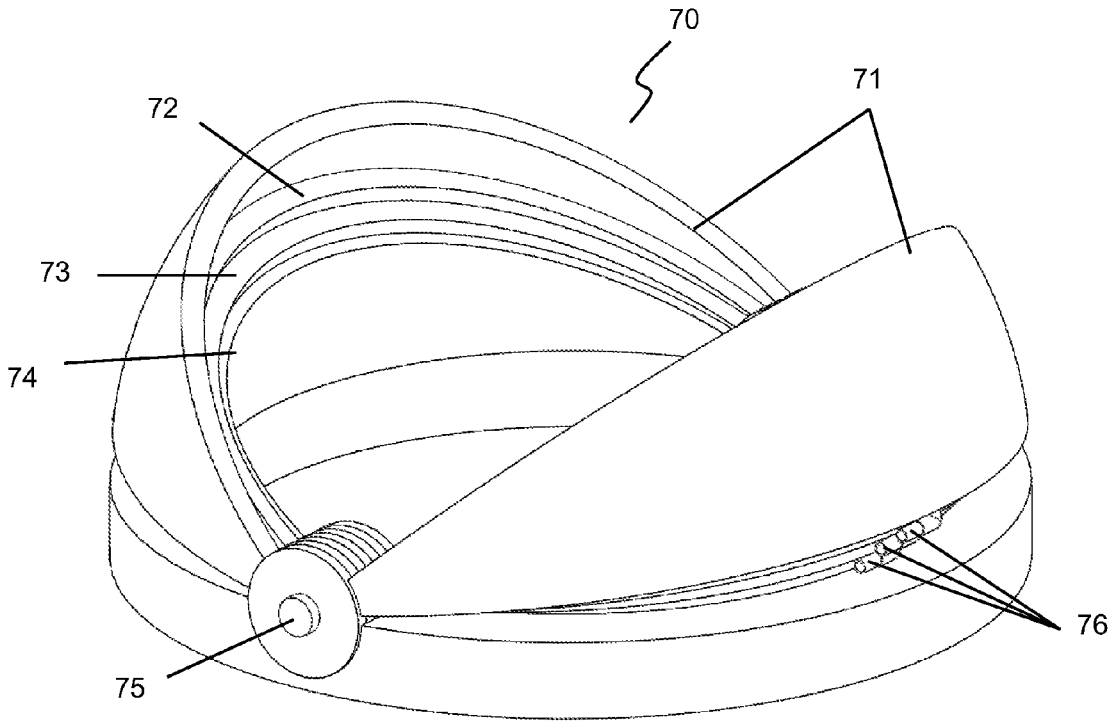
FIG. 11 is a drawing that shows the alternative embodiment of the FCS invention in the open position.
Figure 12:
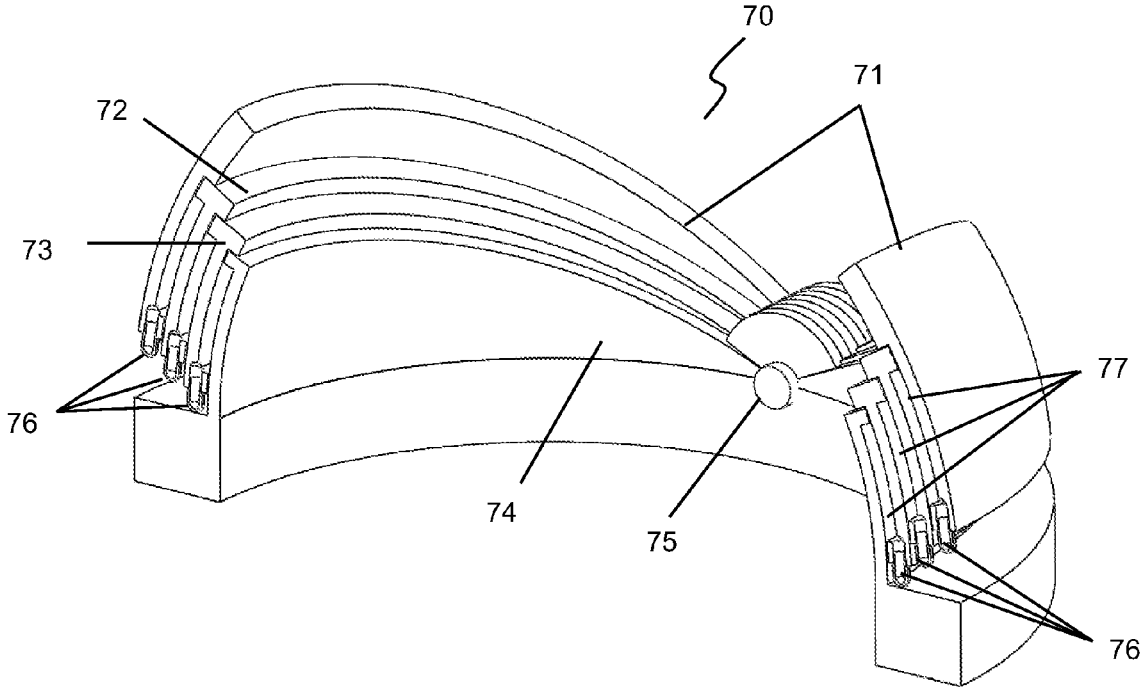
FIG. 12 is a drawing that shows a sectioned view of the alternative embodiment of the FCS invention in the open position.

FIG. 11 shows how sections 71, 72, and 73 lie on the base section 74 after the FCS 70 is activated and is fully opened. FIG. 12 is a sectioned view of FIG. 11, which shows the final volume of the gaps 77 once the FCS 70 is fully open.

Figure 13:
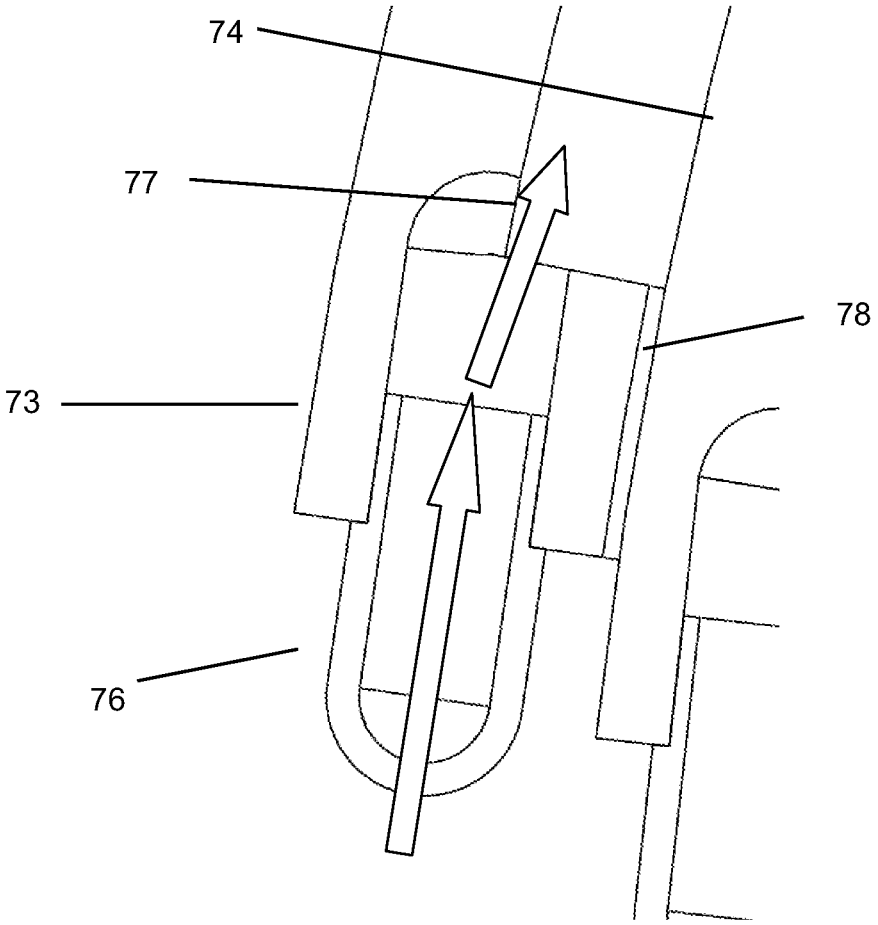
FIG. 13 is a drawing that shows a close up side sectioned view of an air port on the alternative embodiment of the FCS invention in the closed position.

FIG. 13 shows the initial volume of the gaps 77 between sections 73 and 74 before the FCS 70 is opened. FIG. 13 also shows how the activating fluid/gas pressure flows into the gap 77 through the port 76. When the FCS 70 is in the closed position, all of the sections interact with each other via flanges at the end of sections 71, 72, 73, and 74. These flanges all contain a sealing surface 78 that can be made up of a linear seal stock of rubber or plastic material, which allows the system to be tightly closed.

Figure 14:
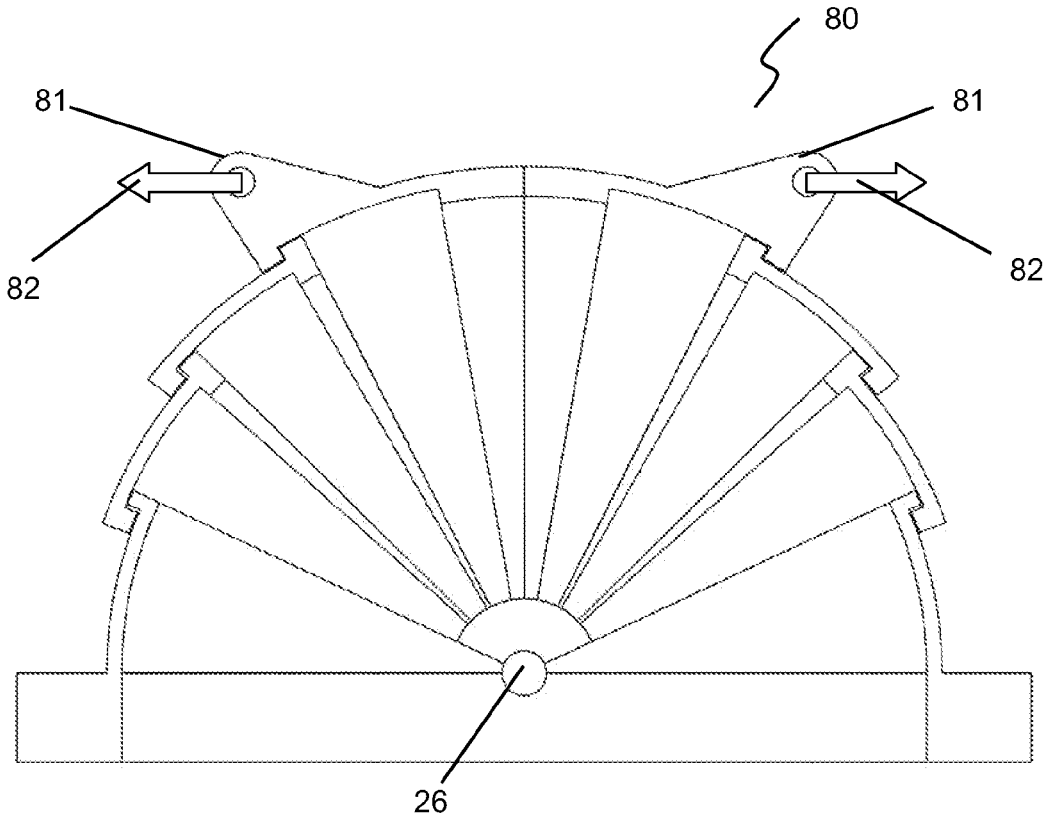
FIG. 14 is a drawing that shows a side sectioned view of the FCS in the closed position with added tabs for mechanical actuation.

FIG. 14 shows how another embodiment of the invention. FCS 80 can be opened by pulling on the tabs 81 in the direction 82. The tabs 81 can be pulled by a number of different devices including hydraulic actuators, electric actuators, mechanical hand crank, and electric motor. Similar to the other embodiments 20, 70 this will cause the sections to rotate about the pin 26, thus causing the system to open.

Figure 15:
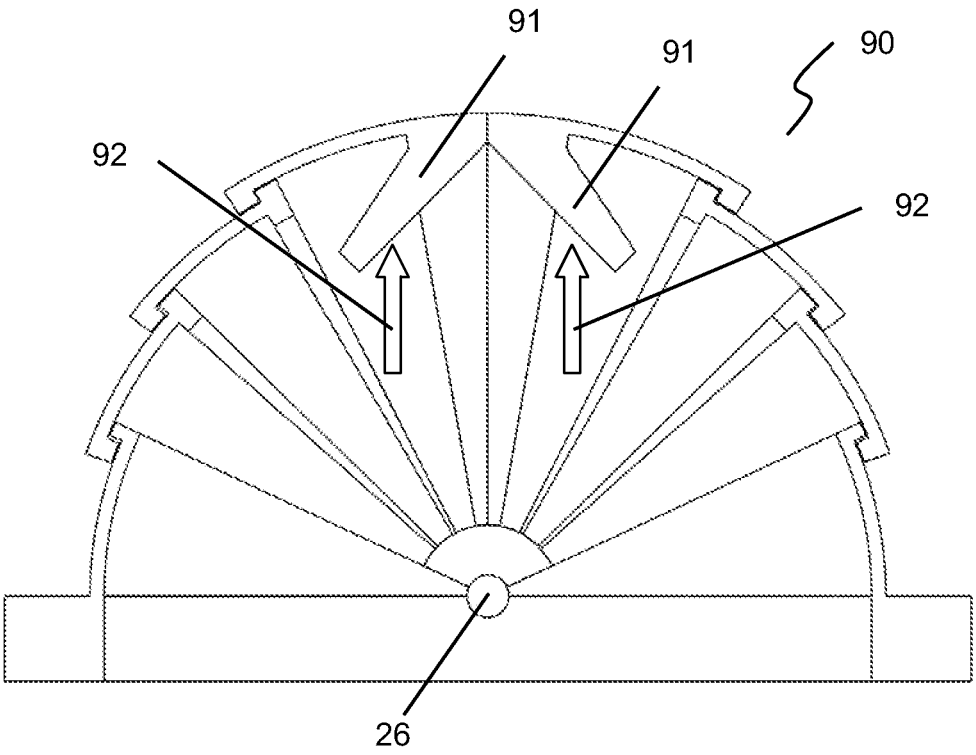
FIG. 15 is a drawing that shows a side sectioned view of the FCS in the closed position with an added inner slide attachment for actuation by the enclosed object.

FIG. 15 shows another embodiment of the invention. FCS 90 can be opened by pushing the sliding attachments 91 inside the shell sections in the direction 92 by the object enclosed by the FCS 90. Similar to the other embodiments 20, 70, 80 this will cause the sections to rotate about the pin 26, thus causing the system to open.

Figure 16:
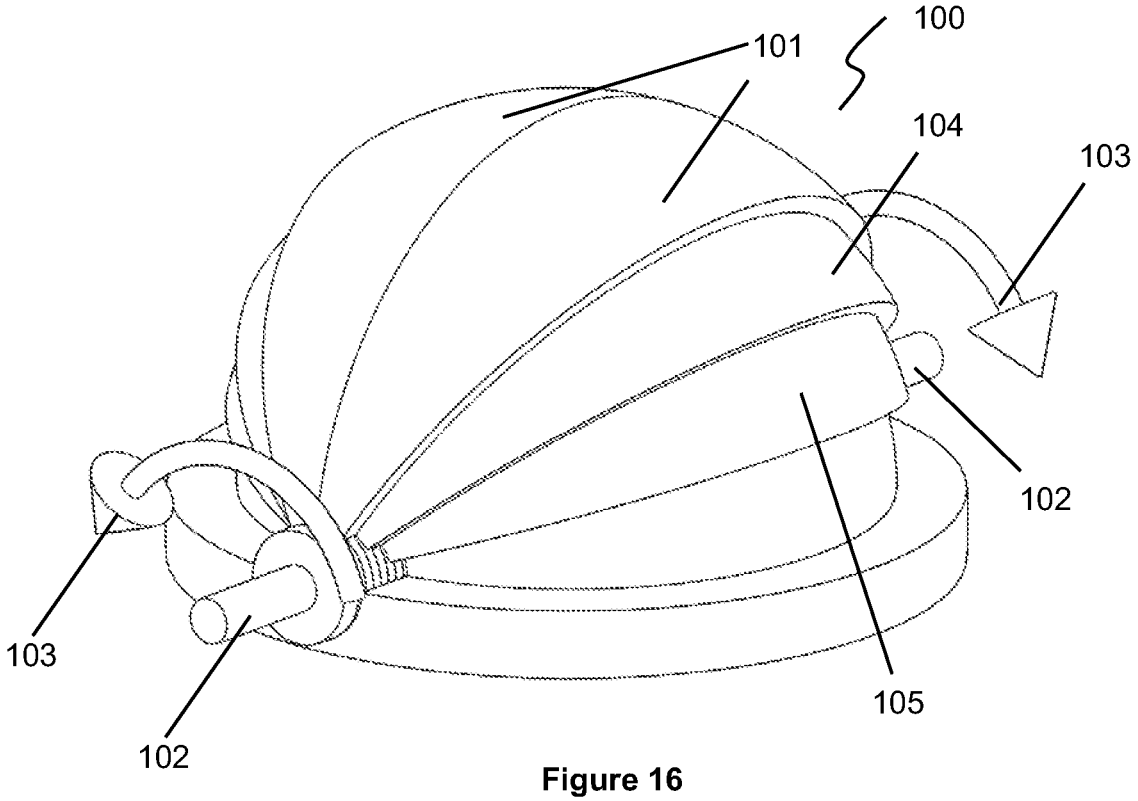
FIG. 16 is a drawing that shows an isometric view of the FCS in the closed position being activated by a rotational device such as an electric motor, a rotary pneumatic or hydraulic actuator.

FIG. 16 shows another embodiment of the present invention. FCS 100 can be opened by rotating the upper sections 101 with a rotary device connected to a shaft 102 such as an electric motor, rotary hydraulic motor, rotary pneumatic motor, or engine. Compared to the FCS design 20 shown in FIG. 1, the alternative FCS design 100 might not require the use of a gearbox 25. The two rotary devices connected to the shaft 102 need to rotate the upper sections 101 in opposite directions 103 causing the sections 101 to move away from each other. When the upper sections 101 begin to rotate, they will pull the other sections 104 and 105 down as well, thus causing the FCS 100 to open.

Figure 17:
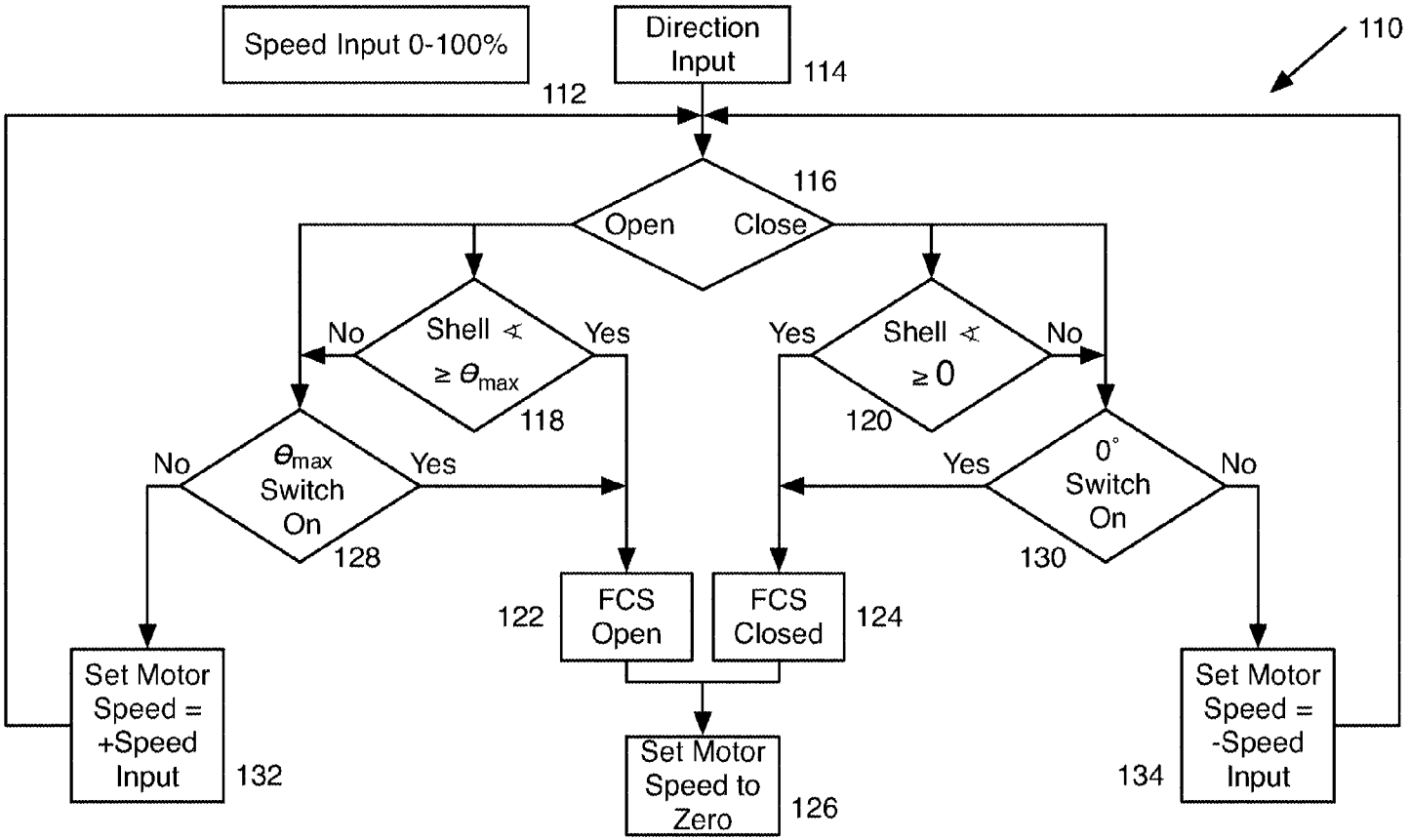
FIG. 17 is a flow diagram showing an illustrative operating sequence for FCS of the present invention.

Referring now to FIG. 17, a flow chart shows an illustrative operating sequence 110 for FCS design 20. The sequence begins with two inputs, the speed input 112 and the direction input 114. The speed input 112 is the desired opening or closing speed of the forward closure system, assuming the speed of the actuator used is adjustable. The direction input 114 determines whether the forward closure system will open or close.

Once the sequence is started, the open close block 116 determines which mechanical switches and angles to use in order to move the system. The system first checks the shell angle to determine if it is greater than or equal to $\theta_{max}$ in block 118 or if it is less than or equal to zero in block 120, if so, then the system is already open or closed as shown at reference numerals 122 and 124 and the motor speed is set to zero at reference numeral 126. If the angle is either less than $\theta_{max}$ or more than zero, then the system checks the mechanical switches in blocks 128 and 130 to see if they are activated. If either switch is activated then the system is already open or closed and as indicated at reference numerals 122 and 124 and the motor speed is set to zero at reference numeral 126. If neither switch is activated then the system sets motor/actuator speed at reference numerals 132 or 134 to the desired input speed set at speed input 112. From reference numerals 132 and 134, the process loops back to reference numeral 114 until the system reaches its desired position. Once the opening or closing is complete as designated by reference numerals 122 or 124, the motor/actuator speed to zero at reference numeral 126.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A forward closure system, comprising:

a cylindrical frame defining a circular opening;

a pair of stationary lune-shaped base sections having a first radius and mounted to an inside surface of the frame, opposed ends of the pair of lune-shaped base sections abutting one another at a rotation axis;

first and second opposed lune-shaped shell assemblies, each assembly including at least an outer shell section and an inner shell section, each inner shell section having a second radius larger than the first radius of the base sections to allow each inner section to slide over one of the base sections, each outer shell section having a third radius larger than the second radius of the inner sections to allow each outer section to slide over one of the inner sections, the lune-shaped inner sections and outer sections rotatably mounted independently of each other at opposed ends thereof along the rotation axis, the inner section of each shell assembly and the base sections being nested within the outer section of each shell assembly when the forward closure system is in an open position, mating edges of the outer sections abutting one another when the forward closure system is in a closed position;

an actuator for each outer shell section; and wherein a first end of each outer shell section in each shell assembly is mounted to a driven rotation plate disposed along the rotation axis and coupled to the actuator for that outer shell section and a second end of each outer shell section in each shell assembly is mounted to a non-driven rotation plate disposed along the rotation axis;

a first end of the inner shell sections in each shell assembly is mounted to a first freewheeling rotation plate disposed along the rotation axis and a second end of the inner shell sections in each shell assembly is mounted to a second freewheeling rotation plate disposed along the rotation axis; and a pin extends from a face of the driven rotation plate of each shell assembly and into a slot in the first freewheeling rotation plate of each shell assembly, the slot defined by an arc subtending a predetermined angle, the pin engaging an edge of the slot to rotate the first freewheeling rotation plate during an opening operation when the outer section has rotated through the predetermined angle from the closed position and to disengage during a closing operation when the inner shell has reached the closed position.

2. The forward closure system of claim 1, further comprising:

an upper seal compression ring formed at a top surface of the frame; and a lower seal compression ring disposed at an inner circumference of the frame.

3. The forward closure system of claim 2, further comprising:

an upper seal mounted to the upper seal compression ring; and a lower seal mounted to the lower seal compression ring.

4. The forward closure system of claim 1 wherein the actuator rotationally coupled to each outer shell section is a motor.

5. The forward closure system of claim 1, further comprising:

a first switch positioned to sense when the opposed shell assemblies are in the opened position;

a second switch positioned to sense when the opposed shell assemblies are in the closed position;

an actuator controller coupled to the first and second switches to disable the actuator rotationally coupled to each outer shell section during the opening operation when the first switch senses that the opposed shell assemblies are in the opened position and during the closing operation when the second switch senses that the opposed shell assemblies are in the closed position.

6. The forward closure system of claim 1 wherein each base section, each inner section, and each outer section includes reinforcing rib/truss type reinforcing members.

7. The forward closure system of claim 1 further including manual operation tabs disposed on inner surfaces of the mating edges of the outer shell sections and shaped to urge apart the mating edges of the opposed outer shell sections upon contact with a launched object.

* * * * *